US005791311A

United States Patent [19]

Ozeki

[11] Patent Number: 5,791,311

[45] Date of Patent: Aug. 11, 1998

[54] OIL PUMP SPROCKET COVER FOR AN INTERNAL COMBUSTION ENGINE

[75] Inventor: Hisashi Ozeki, Hamamatsu, Japan

[73] Assignee: Suzuki Motor Corporation, Shizuoka-Ken, Japan

[21] Appl. No.: 679,613

[22] Filed: Jul. 10, 1996

[30] Foreign Application Priority Data

| | | | |
|---|---|---|---|
| Jul. 20, 1995 | [JP] | Japan | 7-206612 |
| Jul. 20, 1995 | [JP] | Japan | 7-206613 |
| Jul. 20, 1995 | [JP] | Japan | 7-206618 |

[51] Int. Cl.[6] ..... F01M 1/00

[52] U.S. Cl. ..... 123/196 R; 123/198 C; 184/6.28

[58] Field of Search ..... 123/196 R, 198 C, 123/195 A; 184/6.28

[56] References Cited

U.S. PATENT DOCUMENTS

| | | | |
|---|---|---|---|
| 4,122,818 | 10/1978 | Hattori | 123/196 AB |
| 5,078,106 | 1/1992 | Matsuo et al. | 123/196 R |

FOREIGN PATENT DOCUMENTS

| | | |
|---|---|---|
| 126610 | 10/1981 | Japan . |
| 16569 | 4/1988 | Japan . |
| 332113 | 12/1993 | Japan . |

*Primary Examiner*—Noah P. Kamen

*Attorney, Agent, or Firm*—Bell Seltzer Intellectual Property Law Group; Alston & Bird LLP

[57] ABSTRACT

An oil pump sprocket cover for an internal combustion engine. One side of the oil pump sprocket cover is fixed to the crankcase and the other side of the oil pump sprocket cover is fixed to the oil pump. The oil pump sprocket cover protects the oil pump sprocket, reduces aeration of the oil flowing through the internal combustion engine, and decreases the flow velocity of the oil existing the oil pump sprocket cover thereby reducing oil mist and oil aeration.

3 Claims, 14 Drawing Sheets

OIL PUMP SPROCKET COVER FOR AN INTERNAL COMBUSTION ENGINE

FIELD OF THE INVENTION

The present invention is directed to an oil pump sprocket cover for an internal combustion engine. More particularly, the present invention is directed to an oil pump sprocket cover which serves dual functions as a cover for an oil pump sprocket and a as a fixing member (stiffener) for supporting an oil pump. Further, the present invention is directed to an oil pump sprocket cover for an internal combustion engine. More particularly, it is directed to an oil pump sprocket cover which reduces aeration in the oil flowing through a clearance between the oil pump sprocket cover and the oil pump. The present invention is also directed to an oil pump sprocket cover for an internal combustion engine such as an oil pump sprocket cover which decreases the flow velocity of oil near the outlet of the oil pump sprocket cover and which reduces the amount of oil mist and the aeration in the oil.

An internal combustion engine is provided with an oil pump for sucking oil in an oil pan and sending it under pressure to lubricate and cool the engine parts. Internal combustion engines of vehicles, include oil which is circulated by the oil pump to lubricate and cool the parts of engine. The oil is stored in the oil pan under the internal combustion engine and is supplied to the parts of the engine and returned to the oil pan after lubricating and cooling the internal combustion engine parts.

For example, as shown in FIGS. 17 and 18, on an internal combustion engine 102, a cylinder head 106 is mounted on a cylinder block 104, and a crankcase 110 for pivotally supporting a crankshaft 108 in cooperation with the cylinder block 104 is provided. An oil pump 112 is provided under the crankcase 110 by means of a plurality of pump attaching bolts (not shown), and the crankshaft 108 is provided with an oil pump driving sprocket 114. On the other hand, an oil pump sprocket 118 is provided on a pump shaft 116 of the oil pump 112. An oil pump chain 120 is set around the oil pump driving sprocket 114 and the oil pump sprocket 118, and an oil pump sprocket cover 122 covers the oil pump sprocket 118. The oil pump sprocket cover 122 is attached to the oil pump 112 by cover attaching bolts 124 as shown in FIG. 18. As shown in FIG. 19, the oil pump sprocket cover 122 is sometimes attached to the lower part of the crankcase 110 by means of cover attaching bolts 124.

One of such types of oil pump sprocket covers for an internal combustion engine is disclosed in Japanese Patent Publication No. 63-16569 (no. 165691/1988). The oil pump sprocket cover disclosed in this Publication is attached to a flange formed on a side wall of the sprocket side of an oil pump body in such a manner as to surround a sprocket attached to a driving shaft extending from the oil pump body. The sprocket cover has a top edge located at least above the highest level of oil and a plurality of elongated holes formed along a virtual circle. The elongated holes each extend in the circumferential direction of the virtual circle. A wall portion attached to the end face of flange through bolts in the elongated holes and a guide portion arranged along a driving chain over a range from the sprocket on the sprocket advance side of driving chain set around the sprocket are formed integrally. The guide portion is provided with a wear resistant elastic material to give tension to the driving chain by always being brought into contact with the driving chain. Therefore, the driving sprocket of the oil pump arranged in the oil does not produce the agitation and scattering of oil and the waving of the oil surface during the rotation of the sprocket. Also, the slack of driving chain set around the driving chain is also prevented.

Japanese Patent Provisional Application No. 5-332113 (No. 332113/1993) discloses another type of an oil pump sprocket cover. In the oil pump attaching construction disclosed in this Publication, an oil pump is arranged in an oil pan, and a cover surrounding a part of the pump sprocket is provided near the pump sprocket to prevent the oil in the oil pan from being agitated when the oil pump is operated. This prevents poor suction of oil at low temperatures, and also prevents the agitation of oil caused by the pump sprocket and a pump driving chain.

The conventional oil pump sprocket covers fulfill the single function of covering the oil pump sprocket. Therefore, the oil pump must be fastened with a predetermined number of pump attaching bolts. This suffers disadvantages of increased weight, increased assembling manpower, and increased cost. As described above, as shown in FIG. 19, on the conventional internal combustion engine, an oil pan 132 is mounted to the lower part of the crankcase 110 of an internal combustion engine 102, and the oil pump 112 is provided in this oil pan 132. The oil pump chain 120 is set around the oil pump sprocket 118 of the oil pump 112, and the oil pump 112 is driven by the driving force of the crankshaft 108 via the oil pump chain 120. The oil pump sprocket cover 122, which is mounted to the crankcase 110, is provided near the oil pump sprocket 118, and a clearance 126 is formed between the oil pump sprocket cover 122 and the oil pump 112. The oil in the oil pump sprocket cover 122 flows out directly into the oil pan 132 through this clearance 126. As a result, the oil having much aeration in the oil pump sprocket cover flows out directly into the oil pan, resulting in the increase in aeration in the oil sucked by an oil strainer disposed in the oil pan. Therefore, there is the possibility of poor suction of the oil strainer, which suffers the disadvantage that the lubricating property of the oil pump, which sends the sucked oil under pressure, is reduced. Accordingly, the reliability of the internal combustion engine is decreased.

If the lubricating property of oil pump is reduced, the wear of the parts being lubricated increases. Thereupon, the service life of parts is shortened, so that the change frequency of parts increases, by which the cost is increased, suffering economical disadvantages. On the other hand, the oil pump sprocket cover 122 enclosing a part of the oil pump sprocket 118 of the oil pump is so arranged that the size of a first clearance S1 formed between the oil pump sprocket cover 122 and the oil pump chain 120 on the inlet side where the oil pump chain 120, which is a driving chain, enters the sprocket cover is approximately equal to the size of a second clearance S2 formed between the oil pump sprocket cover 122 and the oil pump chain 120 on the outlet side where the oil pump chain 120 leaves the sprocket cover. Consequently, the outlet-side inner surface of the oil pump sprocket cover 122 is close to the oil pump chain 120. Hence, the outlet-side inner surface acts as a guide mount, as if it is a launch mount, of oil in the oil pump sprocket cover 122, so that a large amount of oil mist is produced in the crankcase 110. Therefore, the capacity of a breather chamber, not shown, in the cylinder head cover 128 must be increased, by which the engine is made large, suffering disadvantages in practical use.

The oil scraped up from the bottom of the oil pump sprocket cover 122 by the oil pump chain 120 is directly affected by the oil pump chain 120 near the second clearance S2. Therefore, the oil flows out through the second clearance S2 without a decrease in velocity. The amount of oil mist in the crankcase 110 is increased and also the aeration in the oil is increased. Therefore, the amount of aeration in the oil sucked by the oil strainer increases, resulting in the reduction in lubricating property and reliability of the engine.

OBJECT AND SUMMARY OF THE INVENTION

To eliminate the above disadvantages, the present intention provides an oil pump sprocket cover for an internal combustion engine having a crankcase pivotally supporting a crankshaft in cooperation with a cylinder block. An oil pump is provided under the crankcase and an oil pump driving sprocket is provided on the crankshaft. An oil pump sprocket is provided on the oil pump. An oil pump chain is set around the oil pump driving sprocket and the oil pump sprocket for covering the oil pump sprocket. One side of the oil pump sprocket cover is fixed to the crankcase and the other side of the oil pump sprocket cover is fixed to the oil pump.

The oil pump sprocket cover in accordance with the present invention serves the dual functions of providing an oil pump sprocket cover and a fixing member (stiffener) for supporting the oil pump. Hence, the number of pump attaching bolts for the oil pump is reduced thereby reducing the weight of the device and the assembling manpower is decreased resulting in a reduced cost.

To eliminate the above-described disadvantages, another mode of the present invention provides an oil pump sprocket cover for an internal combustion engine having a driving chain for connecting an oil pump sprocket to an oil pump driving sprocket fixed to the end of a crankshaft. An oil pump driven by the rotation force of the crankshaft is also provided for surrounding the oil pump sprocket of the oil pump. A bracket is provided under a clearance between the oil pump sprocket cover and the oil pump to fix the oil pump sprocket cover to the oil pump, receive oil flowing out through the clearance, and cause the oil to flow down into an oil pan after aeration in the oil is reduced. Accordingly, when oil flows out through the clearance between the oil pump sprocket cover and the oil pump, the bracket receives the oil, and causes the oil to flow down into the oil pan after the aeration in the oil is reduced.

The bracket can perform the function of connecting the oil pump sprocket cover to the oil and the further function of temporarily shutting off the flow of oil flowing through the clearance, which is advantageous in practice use. Also, the oil flowing out through the clearance between the oil pump and the oil pump sprocket cover is received by the bracket, and allowed to flow down into the oil pan after the aeration in oil is reduced in the bracket. Thereby, the aeration in oil can be reduced when the oil is sucked through the oil strainer, so that the lubricating condition of the whole of the internal combustion engine is improved, which contributes to the improvement in reliability. Further, since the aeration in oil can be reduced, the lubricating property of the oil pump can be enhanced. That is to say, the wear of the parts being lubricated is prevented, so that the service life of parts can be increased. Thereupon, the change frequency of parts is reduced, so that the cost is increased, which is economically advantageous.

To eliminate the above-described disadvantages, still another embodiment of the present invention provides an oil pump sprocket cover for an internal combustion engine having a driving chain for connecting an oil pump sprocket to an oil pump driving sprocket fixed to the end of a crankshaft, and an oil pump driven by the rotation force of the crankshaft for surrounding the oil pump sprocket of oil pump. As such, a first clearance is formed between the oil pump sprocket cover and the driving chain on the inlet side where the driving chain enters the oil pump sprocket cover. Additionally, a second clearance is formed between the oil pump sprocket cover and the driving chain on the outlet side where the driving chain leaves the oil pump sprocket cover so that the second clearance is larger than the first clearance to reduce the amount of oil mist and the aeration by decreasing the flow of oil in the vicinity of the outlet of the oil pump sprocket cover. Therefore, when the crankshaft rotates, the oil pump driving sprocket fixed to the crankshaft is rotated, and the rotation force of the oil pump driving sprocket rotates the oil pump force of the oil pump driving sprocket rotates the oil pump sprocket via the pump driving chain, by which the oil pump is driven. When the oil pump is driven, the second clearance, which is formed larger, decreases the flow velocity of oil near the outlet of the oil pump sprocket cover, so that the amount of oil mist and aeration are reduced.

Also, by reducing the amount of oil mist, a breather chamber in a cylinder head cover can be made compact, which is advantageous in practical use. Further, since the aeration in oil can be reduced, the lubricating property of the whole of the internal combustion engine is improved, when contributes to the improvement of reliability.

DETAILED DESCRIPTION

Figure 11:
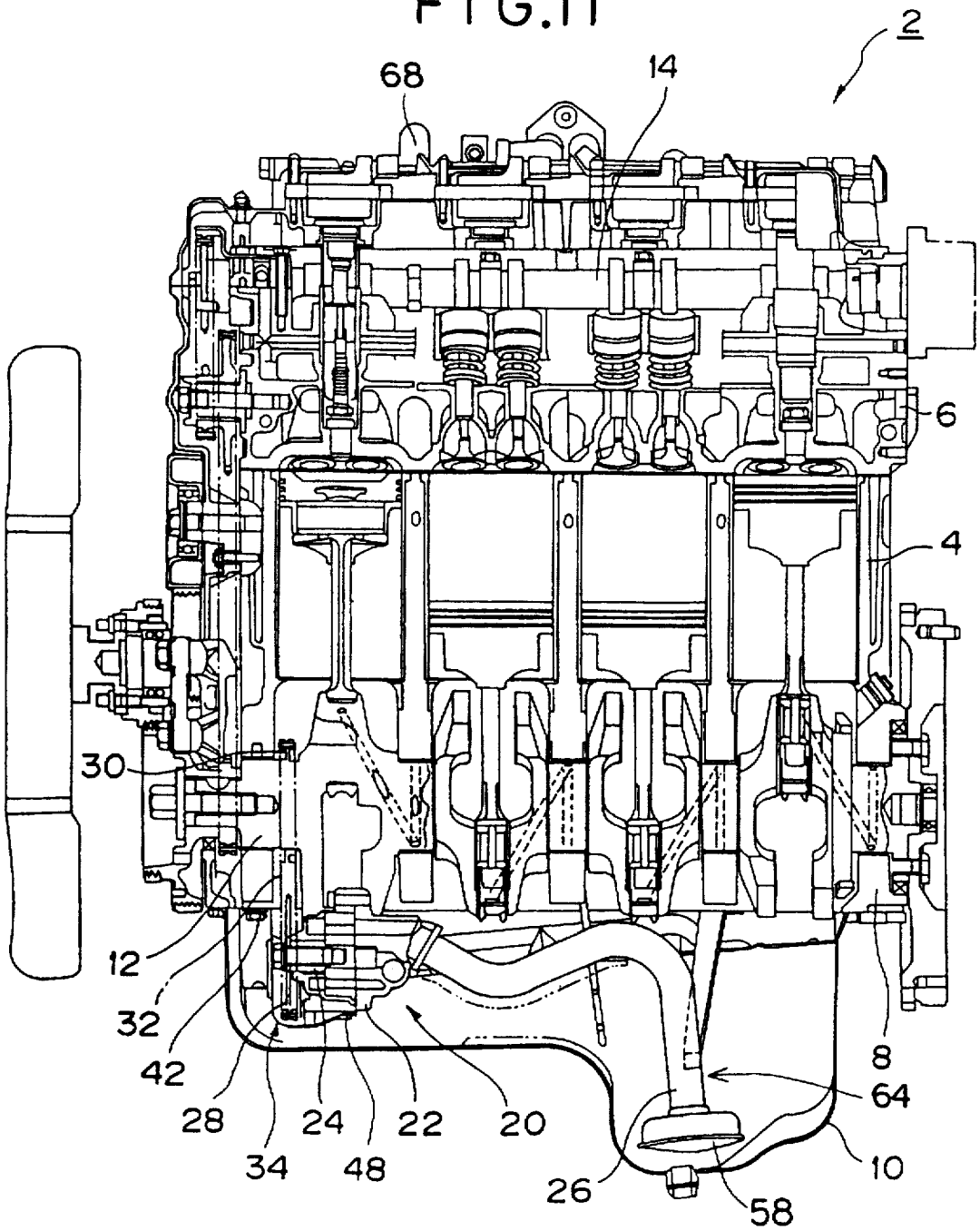
FIG. 11 is a sectional view of an internal combustion engine.
Figure 12:
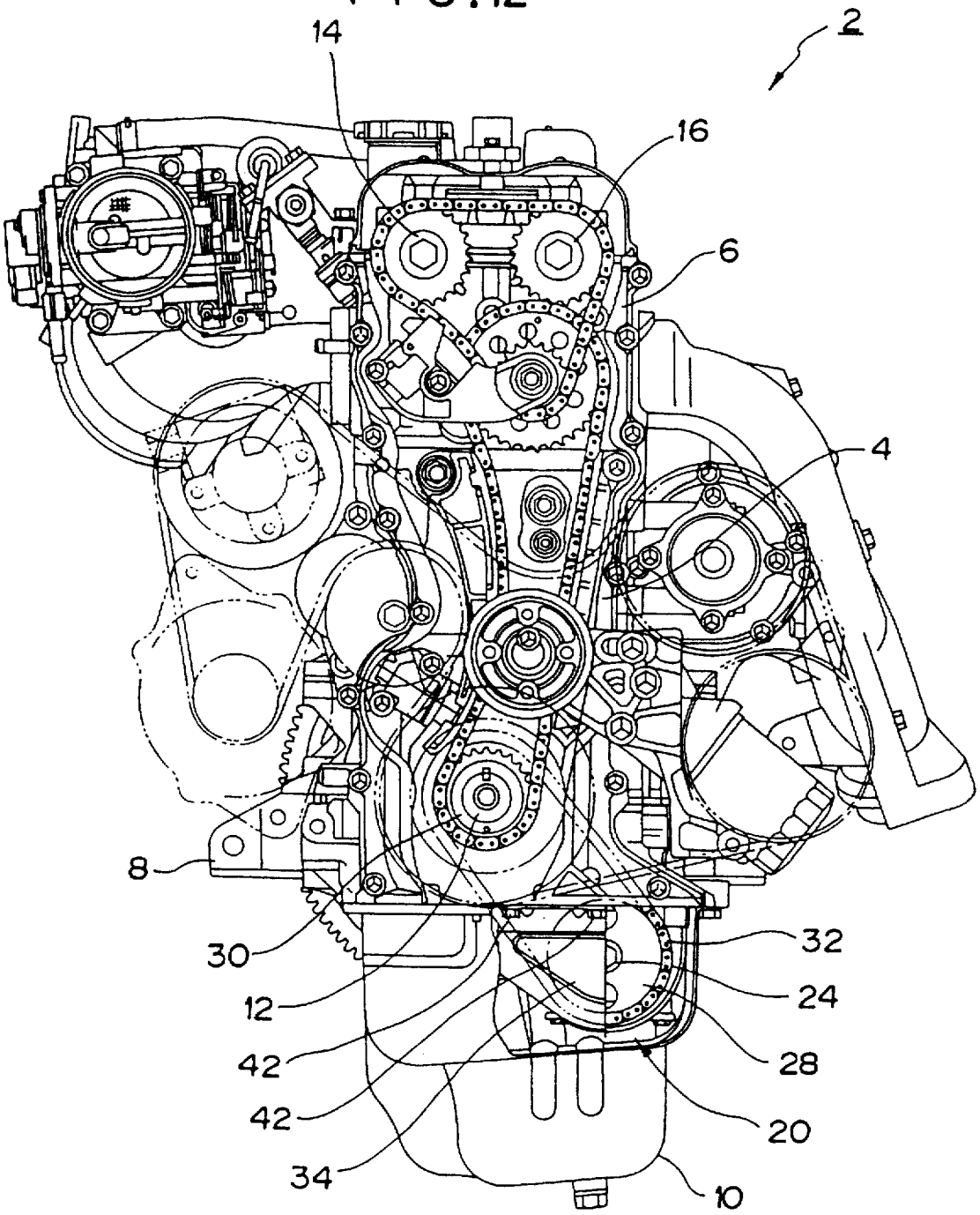
FIG. 12 is a front view of the internal combustion engine.

The embodiments of the present invention will be described in detail and specifically with reference to the drawings. An internal combustion engine 2 is illustrated in FIGS. 11 and 12 and includes a cylinder block 6, a cylinder head, a crankcase 8, and oil pan 10. At the lower part of the cylinder block 4, a crankshaft 12 is pivotally supported in cooperation with the upper part of the crankcase 8. The cylinder head 6 is pivotally provided with a suction-side camshaft 14 and an exhaust-side camshaft 16.

Figure 1:
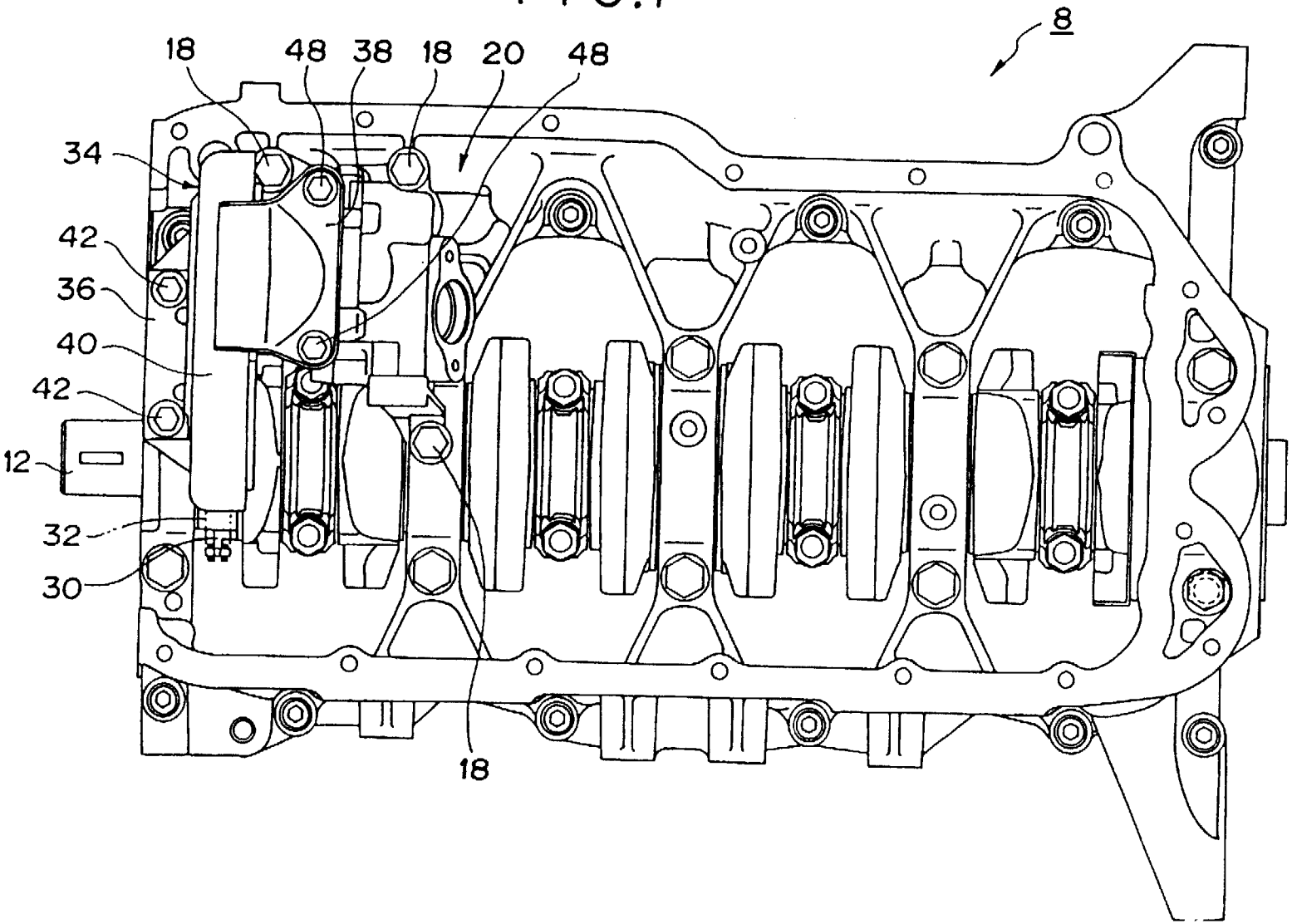
FIG. 1 is a bottom plan view of a crank case after an oil pump sprocket cover in accordance with one embodiment of the present invention is attached.
Figure 2:
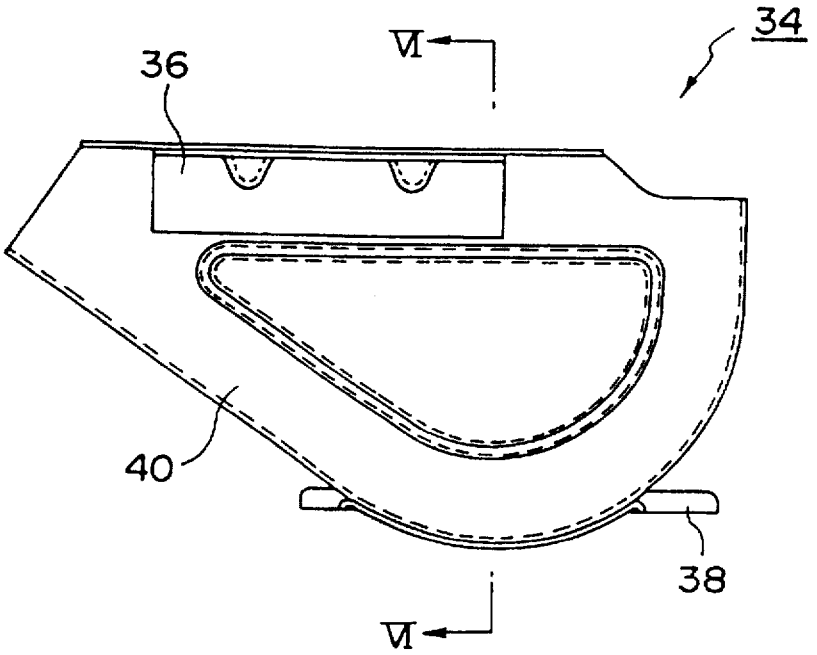
FIG. 2 is a front elevational view of the oil pump sprocket cover shown in FIG. 1.
Figure 3:
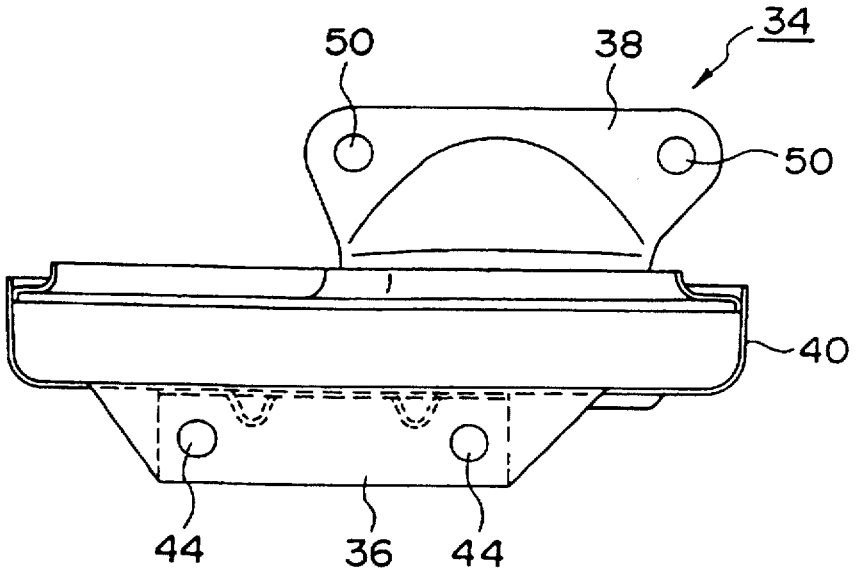
FIG. 3 is a plan view of the oil pump sprocket cover shown in FIG. 1.
Figure 4:
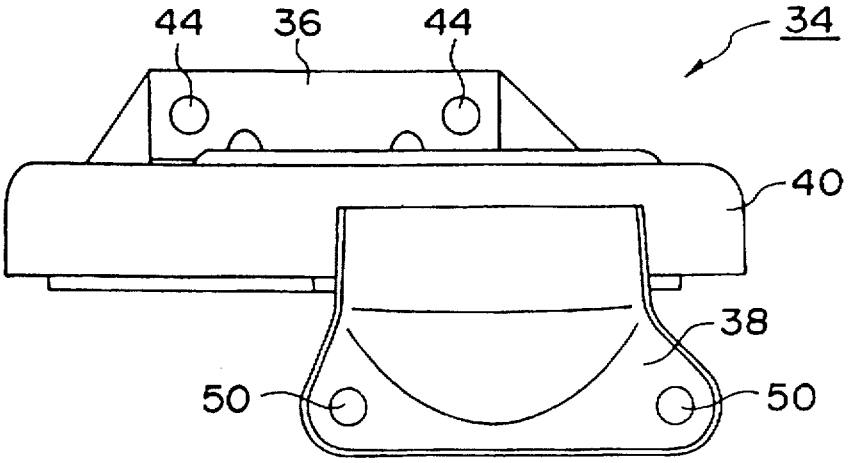
FIG. 4 is a bottom view of the oil pump sprocket cover shown in FIG. 1.
Figure 5:
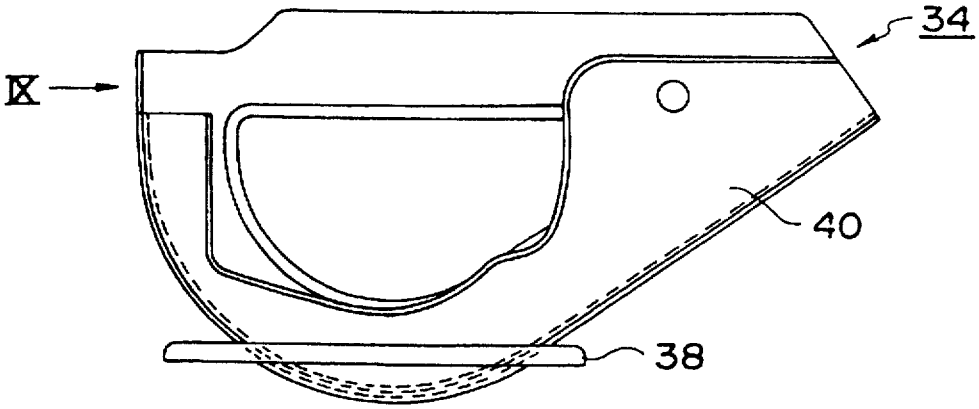
FIG. 5 is a ear view of the oil pump sprocket is cover shown in FIG. 1.

An oil pump 20 is mounted to the lower part of the crankcase 8 by three pump attaching bolts 18, arranged in a predetermined manner as shown in FIG. 1. The oil pump 20 sucks the oil in the oil pan 10 through a suction pipe 26 and sends the oil to the parts of the internal combustion engine 2 under pressure by the rotation of the pump shaft 24 pivotally mounted in a pump case 22. An oil pump sprocket 28 is fixed to the pump shaft 24. At the end of the crankshaft 12, an oil pump driving sprocket 30 is fixed at a position corresponding to the position of the oil pump sprocket 28. An oil pump chain 32 is positioned around the oil pump driving sprocket 30 and the oil pump sprocket 28.

To cover the oil pump sprocket 28, an oil pump sprocket cover 34 is attached to the lower part of the crankcase 8 and the lower part of the oil pump 20.

Figure 10:
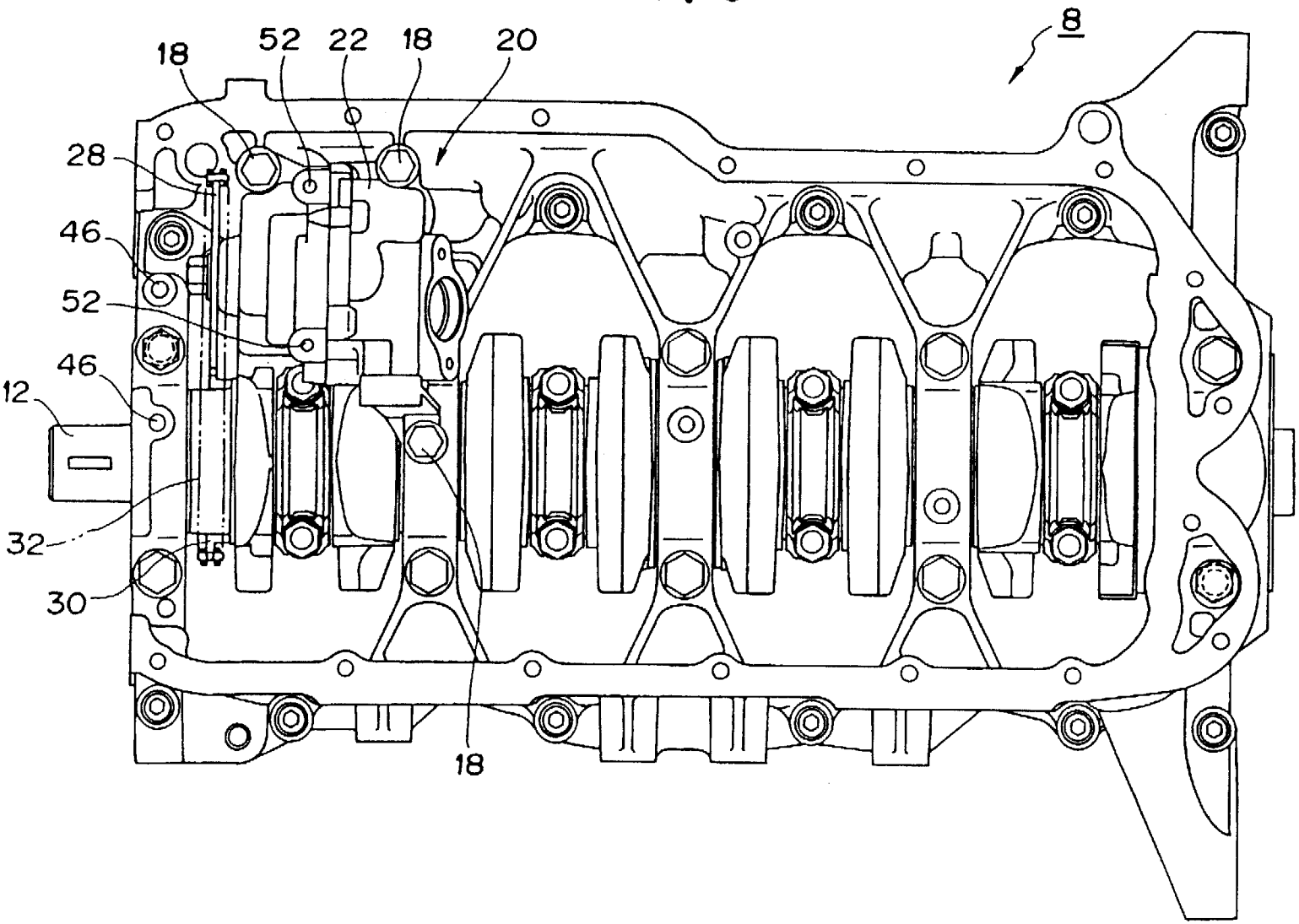
FIG. 10 is a bottom view of the crankcase before the oil pump sprocket cover is attached.

The oil pump sprocket cover 34 has, as shown in FIGS. 2 to 9, a crankcase attaching portion 36 on one side, an oil pump attaching portion 38 on the other side, and a cover portion 40 for connecting the crankcase attaching portion 36 to the oil pump attaching portion 38 and for covering the oil pump is sprocket 28. The crankcase attaching portion 36 is formed with case-side bolt holes 44 for inserting case-side fastening bolts 42. As shown in FIG. 10, the case-side fastening bolts 42 attach the crankcase attaching portion 36 to the bottom of the crankcase 8 by being screwed in case-side screw holes 46 formed on the bottom of the crankcase 8.

The oil pump attaching portion 38 is formed with pump-side bolt holes 50 for inserting the pump-side fastening bolts 48. As shown in FIG. 10, the pump-side fastening bolts 48 attach the oil pump attaching portion 38 to the oil pump 20 by being screwed in pump-side screw holes 52. The pump-side screw holes 52 are formed, as shown in FIG. 10, on the bottom where the pump attaching bolts 18 are not present, i.e., on the bottom of the pump case 22.

Figure 6:
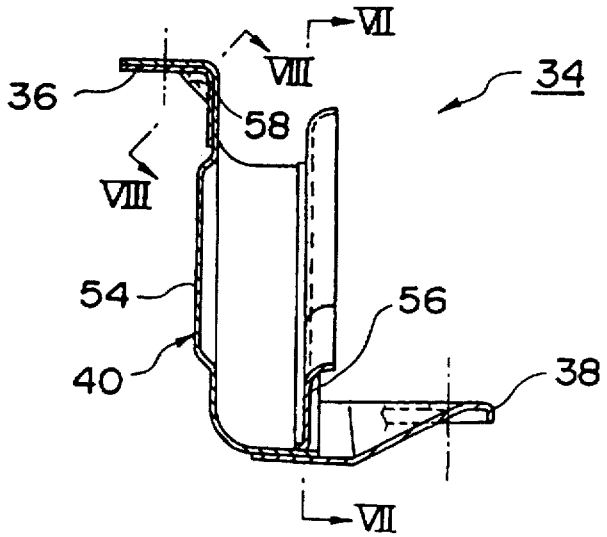
FIG. 6 is a sectional view taken along the line VI—VI of FIG. 2.
Figure 7:
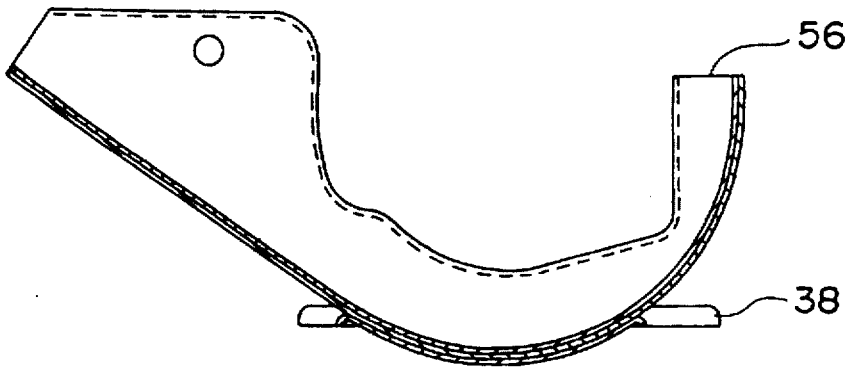
FIG. 7 is a sectional view taken along the line VII—VII of FIG. 6.
Figure 8:
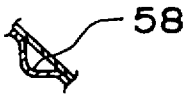
FIG. 8 is a sectional view taken along the line VIII—VIII of FIG. 6.
Figure 9:
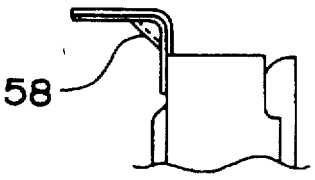
FIG. 9 is a side view taken in the arrow IX direction of FIG. 5.

As shown in FIG. 6, the cover portion 40 comprises one side member 54 overlapping the crankcase attaching portion 36 on one side and the other side member 56 connecting to one side member 54 and one side of the crankcase attaching portion 36 on the oil pump attaching portion 38 side. The overlapping portion of side member 54 and the crankcase attaching portion 36 is formed approximately at right angles and maintains a predetermined strength using a reinforcing member 58 (as shown in FIG. 6).

The operation of present invention will now be described in detail. The cover portion 40 is disposed to cover the oil pump sprocket 28 so as to connect the crankcase 8 to the pump case 22. Thereupon, the oil pump sprocket cover 34 serves not only as a cover for covering the oil pump sprocket 28 but also as a fixing member (stiffener) for supporting an oil pump 20 to the crankcase 8. Consequently, the oil pump 20 can be fixed to the crankcase 8 by using the oil pump sprocket cover 34. Therefore, the number of the pump attaching bolts 18 for attaching the oil pump 20 directly to the crankcase 8 can be decreased to three, which reduces the weight of the oil pump 20, reduces the assembling manpower, and thereby decreases costs.

Figure 13:
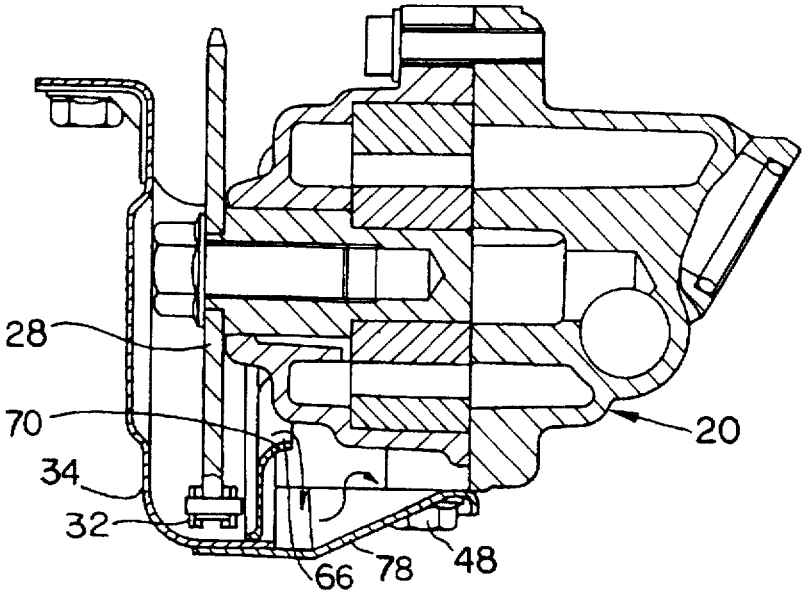
FIG. 13 is a diagrammatic enlarged sectional front view of an oil pump sprocket cover in accordance with another embodiment of the present invention and an oil pump.
Figure 14:
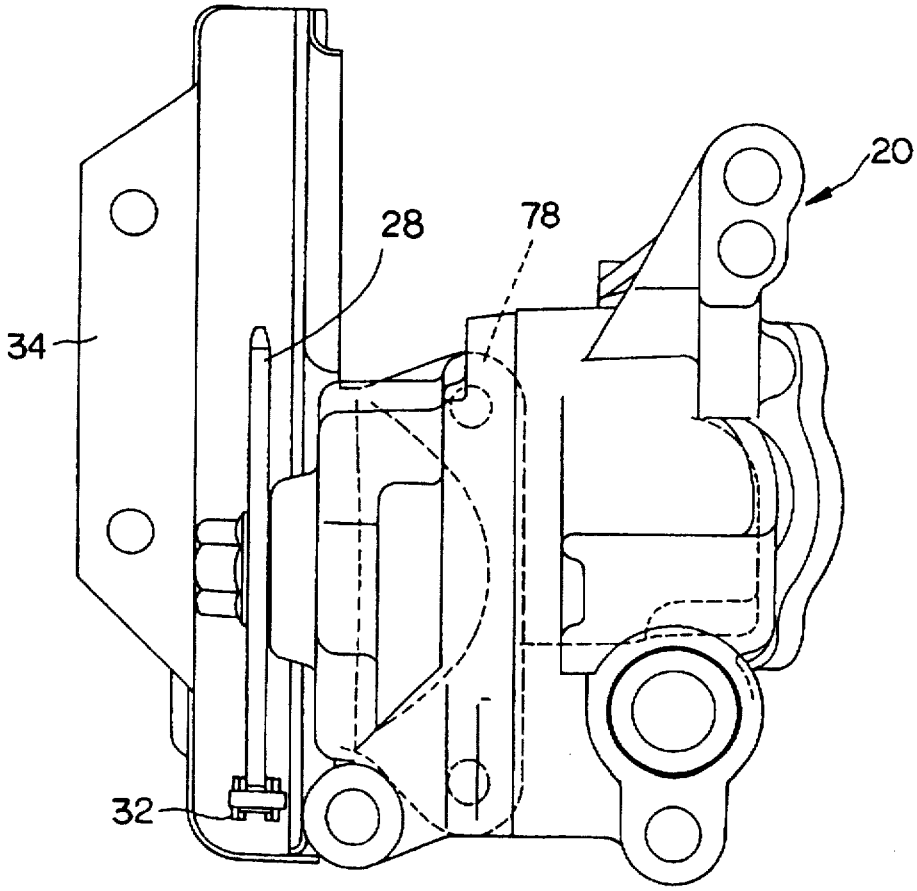
FIG. 14 is a diagrammatic enlarged sectional plan view of the oil pump sprocket cover and the oil pump shown in FIG. 13.

FIGS. 13 and 14 show another embodiment of the present invention. In this embodiment of the present invention, the same reference numerals are applied to the same parts as those in the above embodiment. On the internal combustion engine 2, a cylinder head 6 and a cylinder head cover 68 are fixed on the supper side of the cylinder block 4. To the lower surface of the cylinder block 4 is attached the upper surface of a crankcase 8. At the lower edge of the crankcase 8 is attached an oil pan 10.

A crankshaft 12 is pivotally supported between the lower surface of the cylinder block 4 and the upper surface of the crankcase 8. This crankshaft 12 is arranged from one end of the internal combustion engine 2 (the left in FIG. 11) toward the other end (the right in FIG. 11). An oil pump driving sprocket 30 is mounted at one end of the crankshaft 12 (the left in FIG. 11).

An oil pump 20 is disposed in an oil pan 10, and an oil pump chain 32 is positioned around an oil pump sprocket 28 of the oil pump 20. An oil pump sprocket cover 34 for surrounding a part of the oil pump sprocket 28 is provided near the oil pump sprocket 28 to prevent the oil in the oil pan from being agitated when the oil pump 20 is driven by the driving force of the crankshaft 12 via the oil pump chain 32.

A clearance 66 is formed between the oil pump sprocket cover 34 and the oil pump 20. Under the clearance 66, a bracket 78 is provided to fix the oil pump sprocket cover 34 to the oil pump 20, receive the oil flowing through the clearance 66, and cause the oil to flow down in tnt oil pan 10 after the aeration in the oil is decreased. This bracket 78 corresponds to the oil pump attaching portion 38 in the above embodiment of the present invention.

Specifically, as shown in FIG. 13, one end of the bracket 78 is fixed to the lower part of the oil pump sprocket cover 34, and the other end thereof extends from the power part of a curved end 70 forming the clearance 66 of the oil pump sprocket cover 34 to the oil pump 20, and is fixed to the lower part of the oil pump 20 by fastening bolts 48.

The oil pump sprocket cover 34 is formed in to a U shape in cross section so as to surround a part of the oil pump sprocket 2, and one end thereof is fixed to the crankcase 8. One end of the bracket 78 is fixed to the lower surface of the oil pump sprocket cover 34. Therefore, the bracket 78 functions as a support member for fixing the oil pump sprocket cover 34 to the oil pump 20.

An oil strainer 64 is disposed in the oil pan 10 and an oil suction pipe 26 provides communication from the oil strainer 64 to the oil pump 20. An oil suction port 15 of the oil strainer 64 is also provided.

This embodiment operates as follows. When the crankshaft 12 rotates, the oil pump driving sprocket 30 fixed to the crankshaft 12 is rotated, and the rotation force of this oil pump driving sprocket 30 drives the oil pump 20 via the oil pump chain 32. At this time, the agitation of oil in the oil pan 10 caused by the oil pump sprocket 28 and the oil pump chain 32 is prevented because the oil pump sprocket cover 34 covers a part of the oil pump sprocket 28. The oil getting into the oil pump sprocket cover 34 is caused to flow out to the outside of the oil pump sprocket cover 34 through the clearance 66 by the rotation of the oil pump chain 32 and the oil pump sprocket 28, and reaches the inside of the bracket 78. The bracket 78 temporarily receives the oil flowing through the clearance 66 so as to cause the oil to flow after a short period of time, and allows the oil to flow down into the oil pan 10 after the aeration in the oil is reduced in the bracket 78. Thereupon, the bracket 78 connects the oil pump sprocket cover 34 to the oil pump 20 and temporarily shuts off the flow of oil flowing through the clearance 66, which is advantageous in practical use.

Also, the oil flowing out through the clearance 66 is provided between the oil pump 20 and the oil pump sprocket cover 34 is received by the bracket 78, and allowed to flow down into the oil pan 10 after the aeration in the oil is reduced in the bracket 78. Thereby, the aeration in the oil can be reduced when the oil is sucked through the oil strainer 64, so that the lubricating condition of the internal combustion engine 2 is improved, which contributes to the improvement in reliability. Further, since the aeration in the oil can be reduced, the lubricating property of the oil pump 20 can be enhanced. There is to say, the wear of the parts being lubricated is prevented, so that the service life of parts can be increased. Thereupon, the change frequency of parts is reduced, so tnt the cost is increased, which is advantageous economically too.

The present invention is not limited to the above embodiment, an various modifications can be made. For example, in another embodiment of the present invention, when the bracket is formed, one end thereof is fixed to the bottom surface of the oil pump sprocket cover formed into a U shape in cross section and the other end thereof is fixed to the lower part of the oil pump by using fastening bolts. However, the bracket may be of any construction such that the bracket is disposed under the clearance between the oil pump sprocket cover and the oil pump and can receive the oil flowing out through the clearance. The attaching portion and attaching construction at both ends of bracket can be changed as desired.

Figure 15:
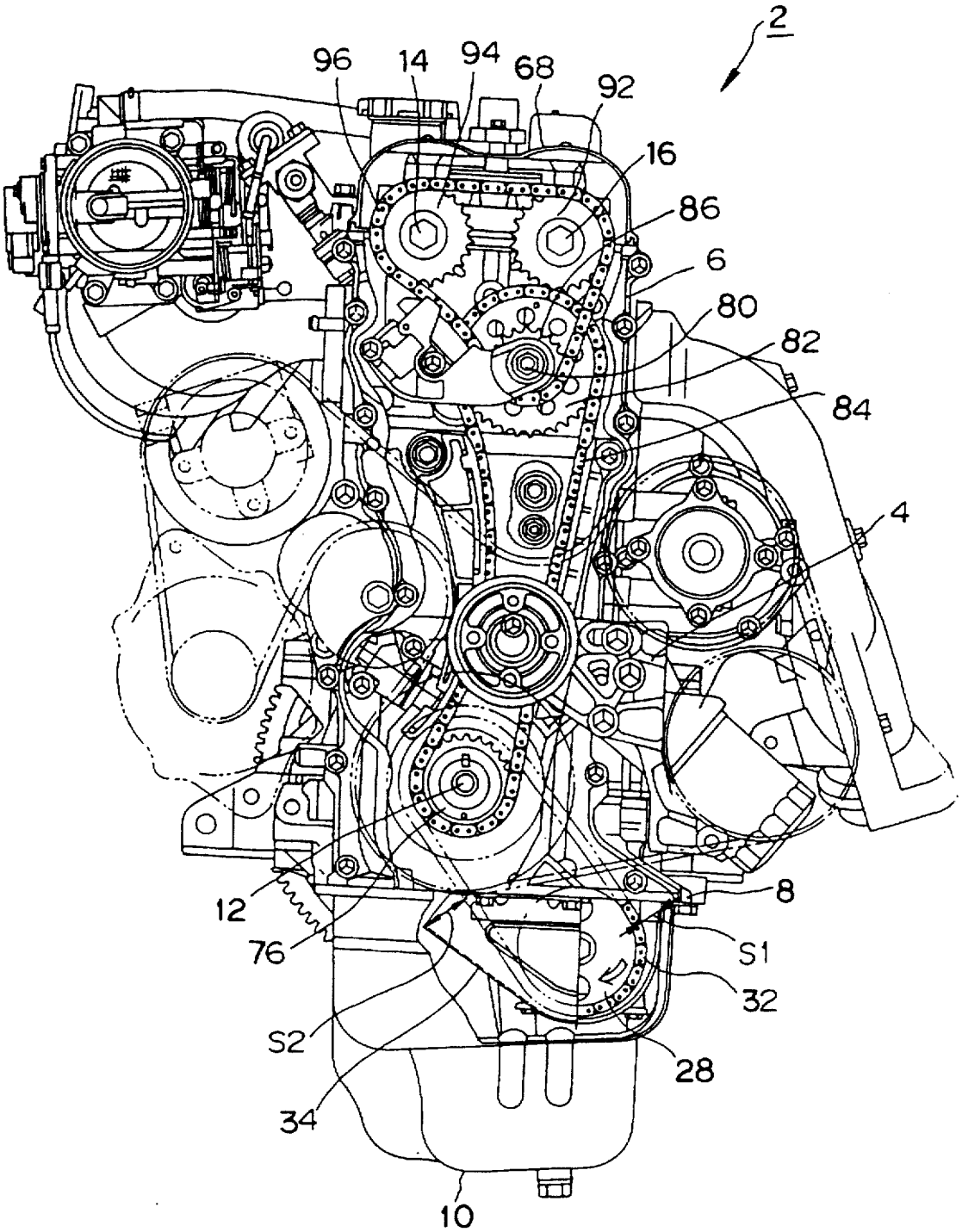
FIG. 15 is a partially cutaway diagrammatic front view of an internal combustion engine in accordance with still another embodiment of the present invention.
Figure 16:
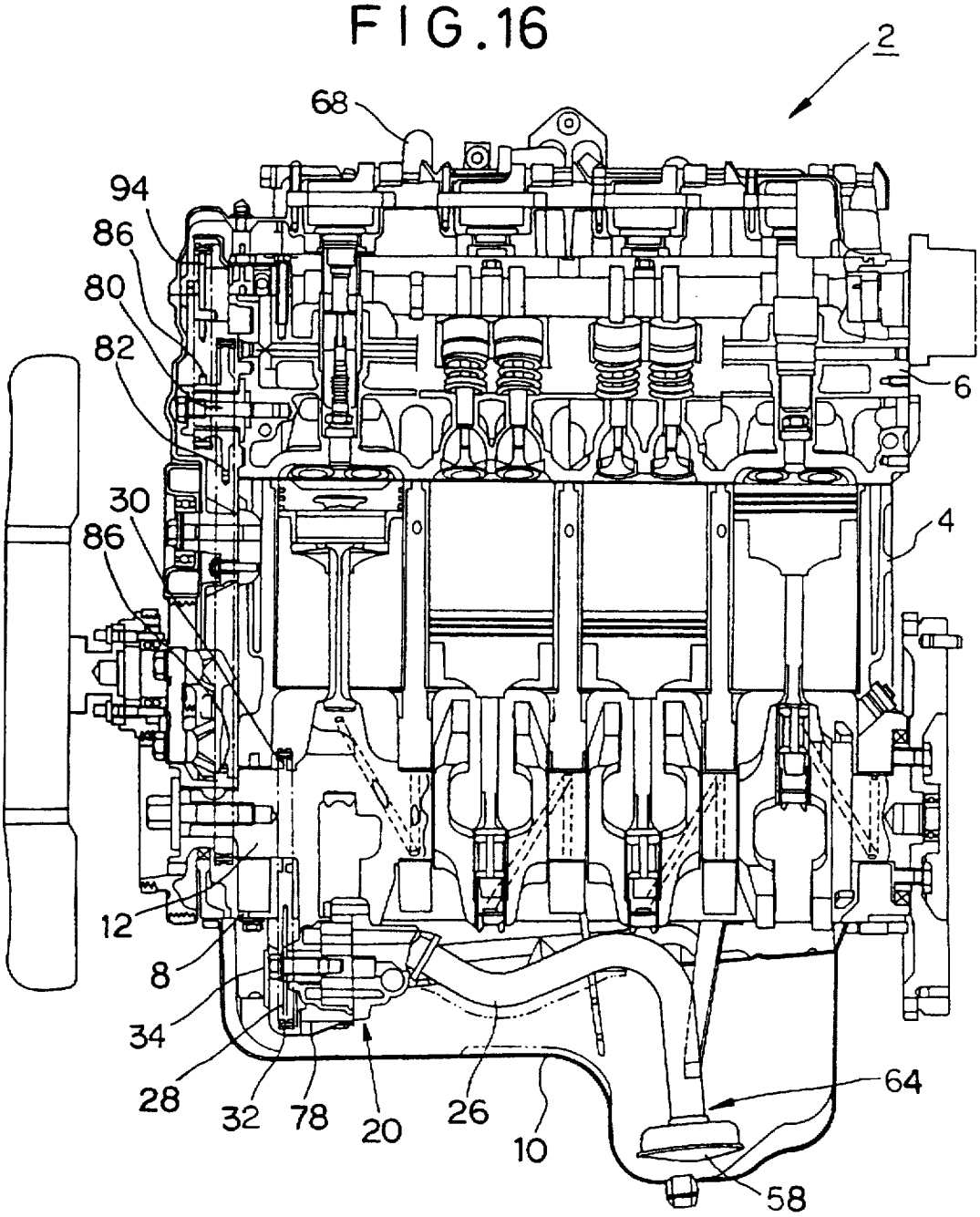
FIG. 16 is a diagrammatic sectional view of the internal combustion engine shown in FIG. 15.
Figure 17:
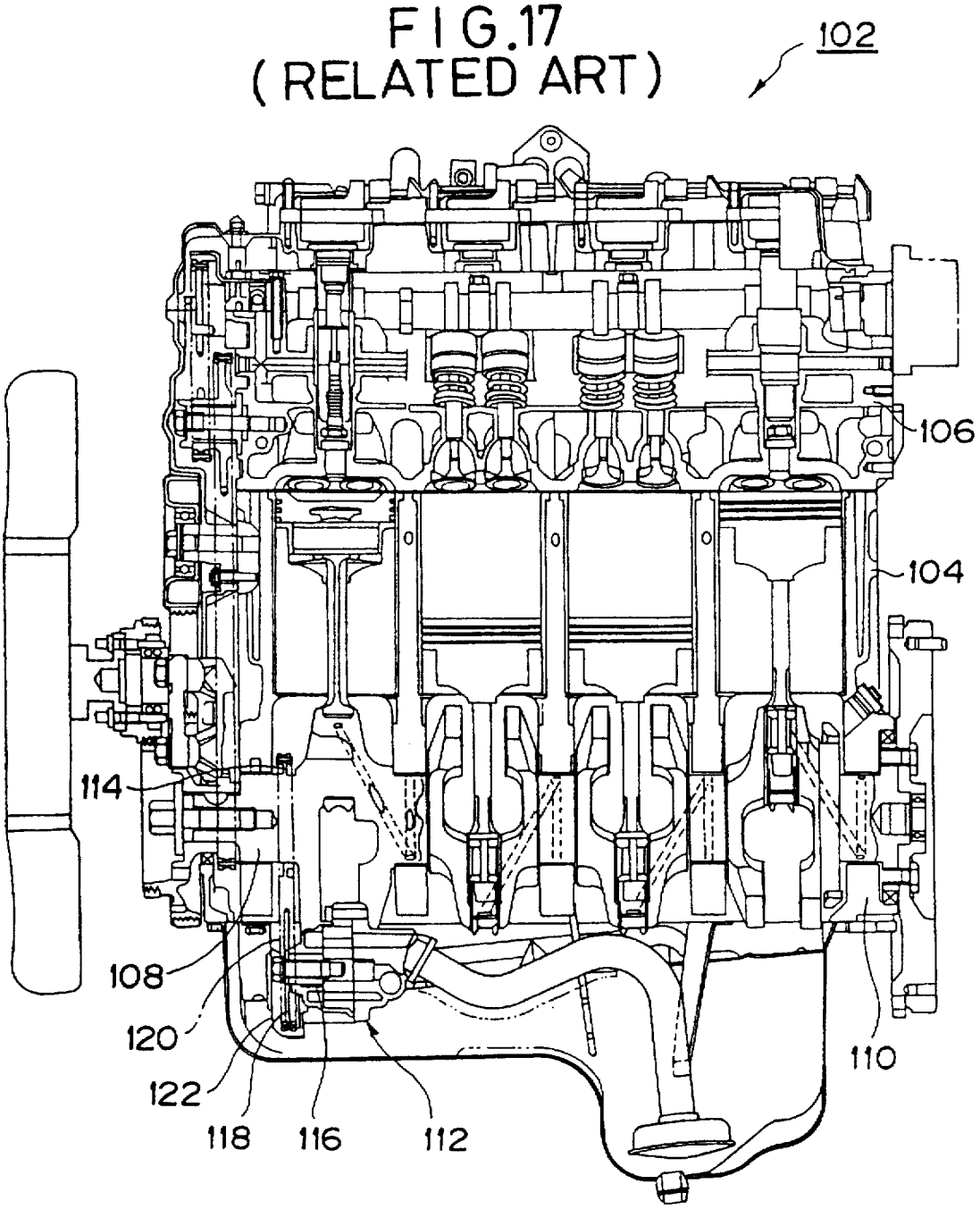
FIG.17 (RELATED ART)
FIG. 17 is a sectional view of a conventional internal combustion engine.
Figure 18:
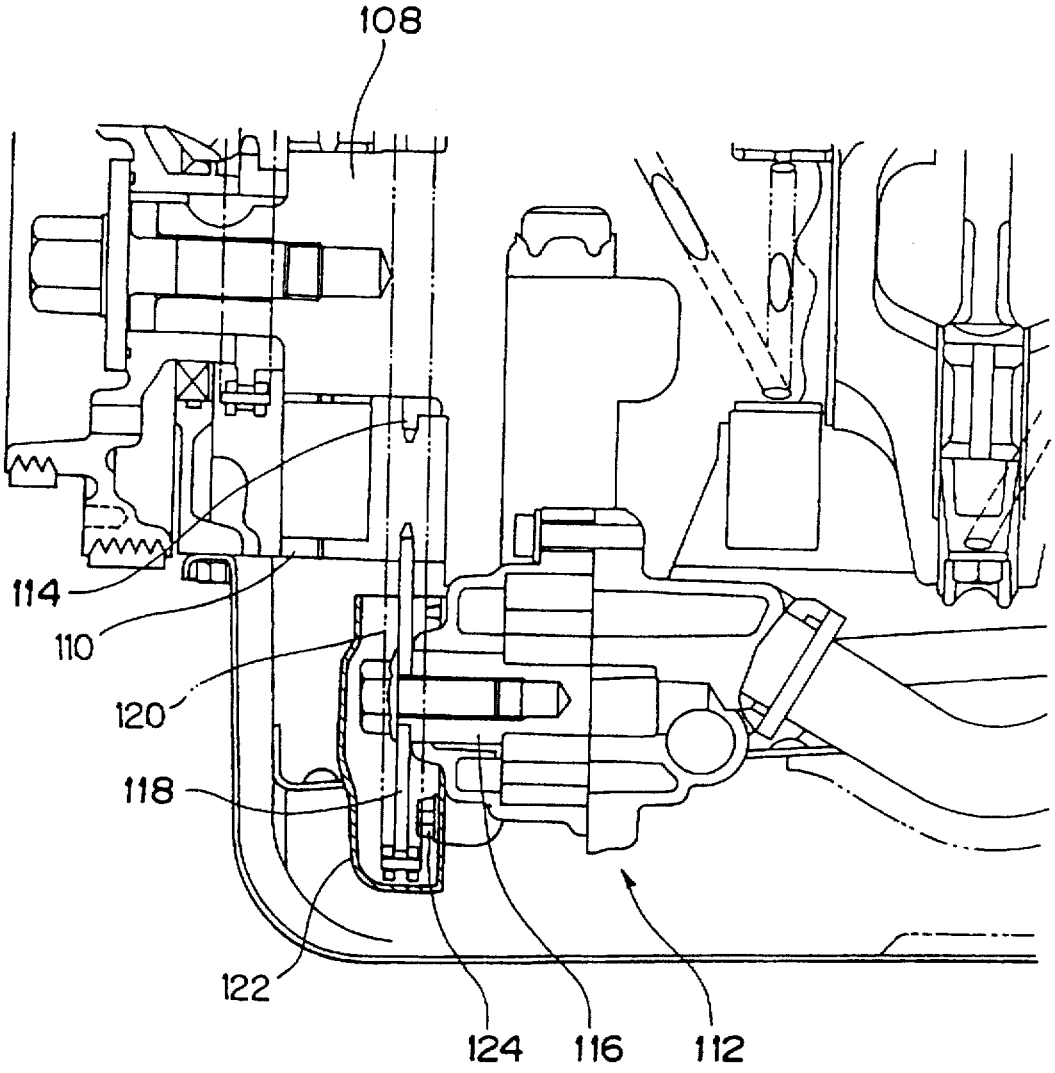
FIG.18 (RELATED ART)
FIG. 18 is a partially sectioned view showing an oil pump sprocket provided in the conventional internal combustion engine.
Figure 19:
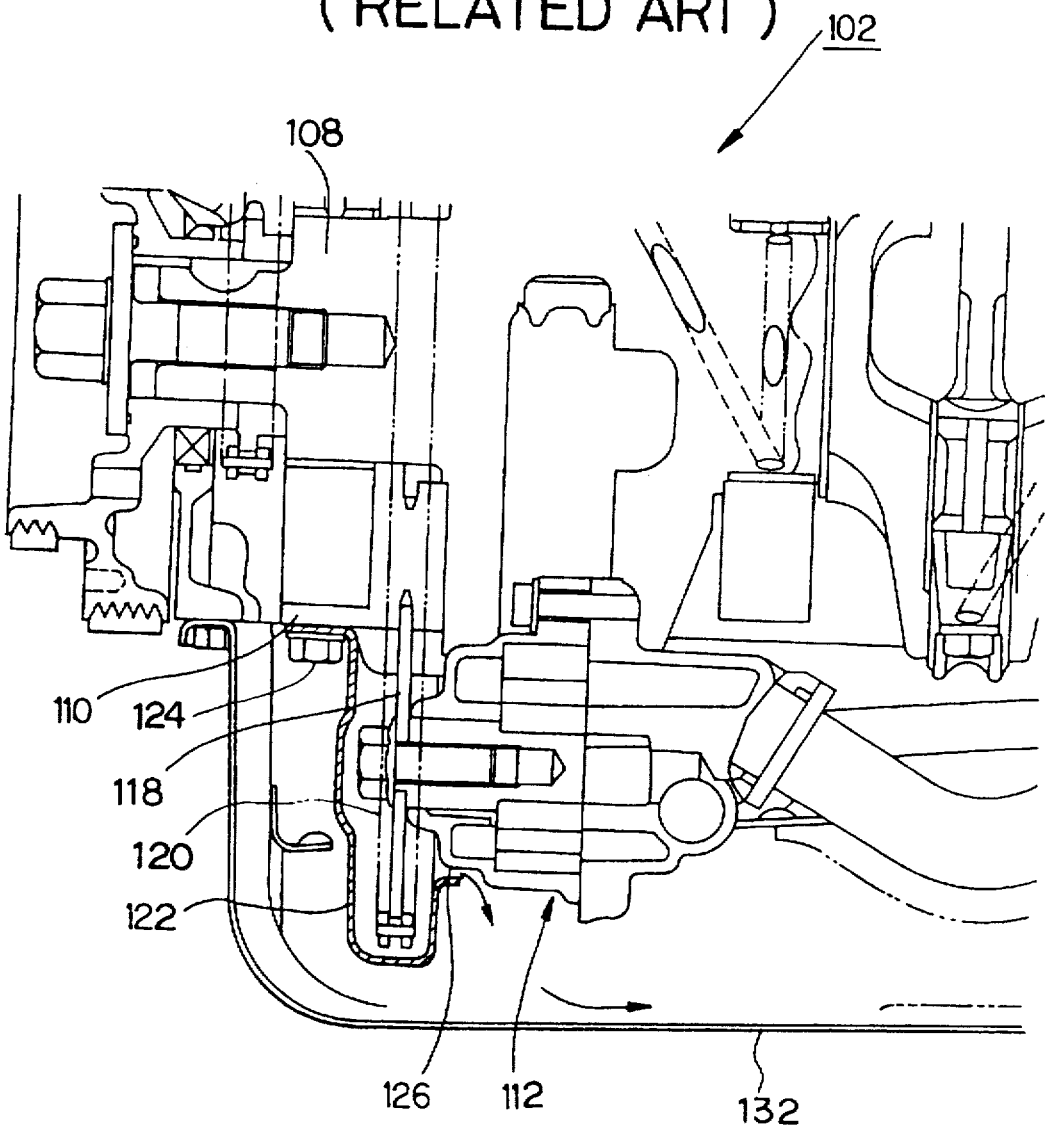
FIG.19 (RELATED ART)
FIG. 19 is an enlarged partially sectioned view showing another sprocket provided in the conventional internal combustion engine.
Figure 20:
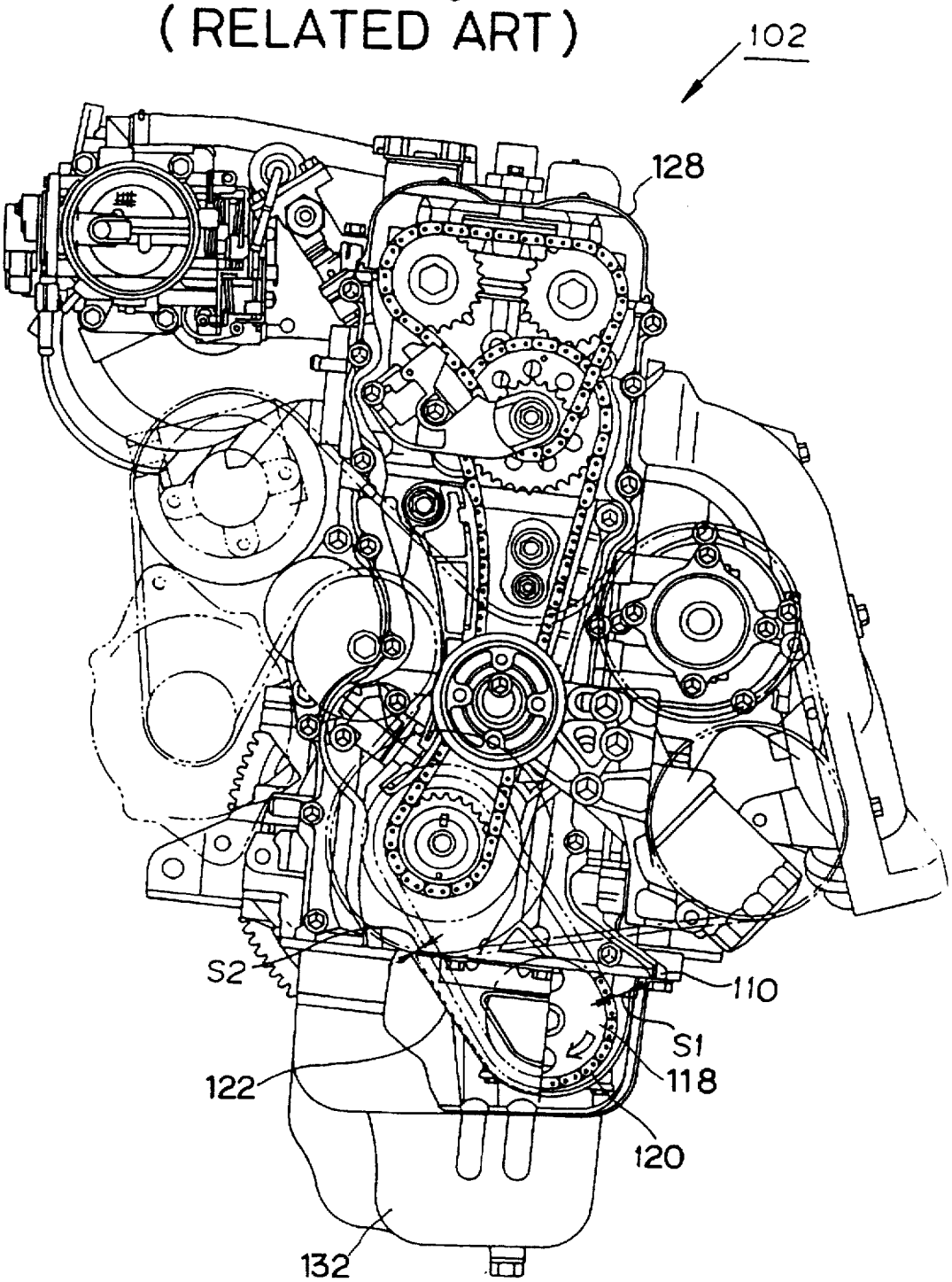
FIG.20 (RELATED ART)
FIG. 20 is a partially cutaway diagrammatic front view of an internal combustion engine showing the prior art of the present invention.

FIGS. 15 and 16 show still another embodiment of the present invention. In this embodiment of the present invention as well, the same reference numerals are applied to the same parts as those in the above embodiment. On an internal combustion engine 2, as shown in FIGS. 15 and 16, at one end of a crankshaft 12 (the left in FIG. 16), a crank sprocket 76 and an oil pump driving sprocket 30 are attached in sequence from one end. A first driving chain 84 is positioned around the crank sprocket 76 and a large-diameter sprocket 82 mounted on an intermediate shaft 80. A second driving chain 96 is positioned around a small-diameter sprocket 86 mounted on the intermediate shaft 80, a first sprocket 92 mounted on a first cam 16, and a second sprocket 94 mounted on a second cam 14. An oil pump 20 is disposed in an oil pan 10, and an oil pump chain 32,k which is a third driving chain, is positioned around an oil pump sprocket 28 of the oil pump 20 and the oil pump driving sprocket 30 of the crankshaft 12.

An oil pump sprocket cover 34 for surrounding a part of the oil pump sprocket 28 is provided near the oil pump sprocket 28 to prevent the agitation of oil in the oil pan 10 caused when the oil pump 20 is driven by the driving force of the crankshaft 12 via the oil pump chain 32. On this oil pump sprocket cover 34, a first clearance S1 is formed between the oil pump sprocket cover 34 and the oil pump chain 32 on the inlet side where the oil pump chain 32 enters the cover. A second clearance S2 is formed between the oil pump sprocket cover 34 and the oil pump chain 32 on the outlet side where the oil pump chain 32 leaves the cover. The second clearance S2 is formed so as to be larger than the first clearance S1 to reduce the amount of oil mist and the aeration in oil by decreasing the flow velocity of oil near the outlet of the oil pump sprocket cover 14. Specifically, as shown in FIG. 15, the second clearance S2 is formed larger gradually from the lower part of the oil pump sprocket cover 34 toward the outlet so that the size of the second clearance S2 near the outlet is about two times the size of the first clearance S3. A bracket 78 for connecting the oil pump sprocket cover 34 to the oil pump 20 is also provided.

In operation, when the crankshaft 12 rotates, the oil pump driving sprocket 30 fixed to the crankshaft 12 is rotated, and the rotation force of this oil pump driving sprocket 30 drives the pump 20 via the oil pump chain 32. At this time, the agitation of oil caused by the oil pump sprocket 28 and the oil pump chain 32 is prevented because the oil pump sprocket cover 34 and the oil pan 10 cover a lower half of the oil pump sprocket 28. The oil getting into the oil pump sprocket cover 34 is discharged through the second clearance S2, which is the outlet of the oil pump sprocket cover 34, by the rotation of the oil pump chain 32 and the oil pump sprocket 28. The oil passes through the second clearance S2, which is formed larger gradually from the lower part of the oil pump sprocket cover 34 toward the outlet so that the size of the second clearance S2 is about two times the size of the first clearance S1, so that the flow velocity of the scraped oil decreases at the second clearance S2. That is to say, the second clearance S2 can reduce the flow velocity of the scraped oil near the outlet, so that the amount of oil mist emitted from the outlet and the aeration can be reduced. Also, by reducing the amount of oil mist, a breather chamber in a cylinder head cover can be made compact, which is advantageous in practical use. Further, since the aeration in oil can be reduced, the lubricating property of the whole of the internal combustion engine is improved, which contributes to the improvement in reliability.

Still further, the second clearance S2 is formed larger gradually from the lower part of the oil pump sprocket cover toward the outlet so that the size of the second clearance S2 is about two times the size of the first clearance S1, so that the flow velocity of oil can be decreased gradually toward the outlet, by which the amount of oil mist emitted from the outlet and the aeration can be reduced effectively.

The present invention is not limited to the above embodiment, and various modifications can be made.

For example, in this embodiment of the present invention, the second clearance is formed so that the size thereof is two times the size of the first clearance. However, the second clearance may be formed into a size exceeding two times the size of the first clearance. A larger size of the second clearance can readily decrease the flow velocity of oil.

I claim:

1. An internal combustion engine comprising a crankcase pivotally supporting a crankshaft in cooperation with a cylinder block, an oil pump positioned under said crankcase, an oil pump driving sprocket positioned adjacent said crankcase, an oil pump sprocket positioned adjacent said oil pump, an oil pump chain positioned around said oil pump driving sprocket and said oil pump sprocket, and an oil pump sprocket cover for covering said oil pump sprocket wherein one side of said oil pump sprocket cover is fixed to said crankcase and another side of said oil pump sprocket cover is fixed to said oil pump.

2. An internal combustion engine comprising an oil pump sprocket cover, a driving chain for connecting an oil pump sprocket to an oil pump driving sprocket fixed to the end of a crankshaft, and an oil pump driven by the rotation force of said crankshaft, wherein said oil pump sprocket cover surrounds said oil pump sprocket of said oil pump and the engine further comprises a bracket positioned under a clearance defined between said oil pump sprocket cover and said oil pump to fix said oil pump sprocket cover to said oil pump, receive oil flowing out through said clearance, and cause the oil to flow down into an oil pan after aeration in the oil is reduced.

3. An internal combustion engine comprising an oil pump sprocket cover, a driving chain connecting an oil pump sprocket to an oil pump driving sprocket fixed to an end of a crankshaft, and an oil pump driven by the rotation force of said crankshaft, wherein said oil pump sprocket cover surrounds said oil pump sprocket of the oil pump, and the engine further comprises a first clearance defined between said oil pump sprocket cover and said driving chain on an inlet side adjacent a location wherein said driving chain enters said oil pump sprocket cover and a second clearance defined between said oil pump sprocket cover and said driving chain on an outlet side adjacent a location wherein said driving chain exits said oil pump sprocket cover so that said second clearance is larger than said first clearance to reduce oil mist and aeration of oil by decreasing the flow velocity of oil in a location adjacent the outlet side of said oil pump sprocket cover.

* * * * *

UNITED STATES PATENT AND TRADEMARK OFFICE
CERTIFICATE OF CORRECTION

PATENT NO. : 5,791,311

DATED : August 11, 1998

INVENTOR(S) : Hisashi Ozeki

It is certified that error appears in the above-identified patent and that said Letters Patent is hereby corrected as shown below:

ON THE TITLE PAGE:

In the References Cited, U.S. PATENT DOCUMENTS, please add the following references:

| | | | |
|---|---|---|---|
| 5,190,005 | 3/1993 | Saito et al. | 123/196 |
| 5,063,895 | 11/1991 | Ampferer | 123/195 |
| 4,883,031 | 11/1989 | Ampferer et al. | 123/196 |

In the References Cited, FOREIGN PATENT DOCUMENTS, please add the following references:

| | | |
|---|---|---|
| 0 304 553 A2 | 3/1989 | European Patent Office |
| 3619577 A1 | 12/1987 | Germany |
| 3816864 A1 | 11/1989 | Germany |
| 3921715 A1 | 1/1991 | Germany |
| 3-260789 | 10/1991 | Japan |
| 2 280 934 A | 10/1994 | Great Britain |
| 4136033 A1 | 5/1992 | Germany |

Signed and Sealed this

Twenty-second Day of December, 1998

Bruce Lehman

*Attest:*

BRUCE LEHMAN

*Attesting Officer*

*Commissioner of Patents and Trademarks*